US006289688B1

(12) United States Patent
da Luz Moraes et al.

(10) Patent No.: US 6,289,688 B1
(45) Date of Patent: Sep. 18, 2001

(54) CONDENSATE DRAIN OUTLET FOR AN AIR CONDITIONER

(75) Inventors: Luciano da Luz Moraes, Canoas; Daniel Alessandro Oliveira de Barros, Novo Hamburgo, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/554,058

(22) PCT Filed: Sep. 16, 1998

(86) PCT No.: PCT/BR98/00076

§ 371 Date: May 9, 2000

§ 102(e) Date: May 9, 2000

(87) PCT Pub. No.: WO00/16014

PCT Pub. Date: Mar. 23, 2000

(51) Int. Cl.[7] ..... F25D 21/14
(52) U.S. Cl. ..... 62/285; 62/288; 62/298
(58) Field of Search ..... 62/298, 285, 288

(56) References Cited

U.S. PATENT DOCUMENTS

| | | | | |
|---|---|---|---|---|
| 5,284,027 | * | 2/1994 | Martin, Sr. | 62/291 |
| 5,437,164 | * | 8/1995 | Consiglio | 62/259.1 |
| 5,511,386 | | 4/1996 | Russ | 62/285 |
| 5,697,227 | * | 12/1997 | Bruce et al. | 62/285 |
| 5,987,909 | * | 11/1999 | Martin, Sr. | 62/291 |

FOREIGN PATENT DOCUMENTS

| | | |
|---|---|---|
| 2275330 | 8/1994 | (GB) . |
| 2280495 | 2/1995 | (GB) . |
| 61122429 | 6/1986 | (JP) . |

* cited by examiner

*Primary Examiner*—William Doerrler
*Assistant Examiner*—Mark Shulman

(57) ABSTRACT

A condensate drain outlet for a room conditioner of the type which includes a sheet metal basepan having a horizontally extending bottom wall and a rear wall joined to and extending upwardly from the bottom wall in a perpendicular relationship. The rear wall has a substantially U-shaped opening formed therein. A one-piece molded plastic condensate drain insert for insertion into the U-shaped opening includes a mounting plate having a size configured to overly the U-shaped opening in the rear wall and having an opening extending therethrough. A tubular section, having an axial opening extending therethrough, extends from one side of the mounting plate. A U-shaped section extends by a distance greater than the thickness of the rear wall from the other side of the mounting plate. The U-shaped section has an open back, and an inner surface which is in fluid communication with the opening in the plate and the opening in the tubular section. The U-shaped section includes an outer surface which is configured to be received in a close tolerance fit with the U-shaped opening in the rear wall. The U-shaped section also includes a peripheral U-shaped retaining flange extending outwardly from the outer surface. The flange has a retaining surface formed thereon, which is spaced from the other side of the mounting plate by a distance substantially equal to the thickness of the rear wall. Accordingly, installation of the drain insert is accomplished by inserting the U-shaped section into the U-shaped opening in the rear wall with the mounting plate in confronting relation and overlying the U-shaped opening. At the same time, the retaining surface of the retaining flange engages the other side of the rear wall.

4 Claims, 4 Drawing Sheets

CONDENSATE DRAIN OUTLET FOR AN AIR CONDITIONER

TECHNICAL FIELD

This invention relates to a room air conditioner and is more specifically directed to the configuration of a one-piece plastic condensate drain insert for the basepan of such an air conditioner.

BACKGROUND ART

Warm air is frequently hurnid, i.e. it contains entrained water vapor. During operation of an air conditioning system in a cooling mode, the evaporator reduces the temperature of the air passing though it to a temperature below the dew point. In that condition, water vapor condenses on the evaporator. Means are provided to collect the condensed water and to direct it to the outdoor section of the air conditioner where at least a portion thereof is quite often directed upon the system's condenser heat exchanger to improve the operating efficiency of the system. Excess condensate, and rain water that may pass into the outdoor unit through openings in the housing of the air conditioning unit, collect in the basepan and it is common practice to provide a drain outlet for conducting such excess to an appropriate disposal location. In small room air conditioners, quite often the basepan of the unit is made from a molded plastic material and a condensate drain may be readily molded into the plastic basepan.

In units having metal basepans the rear of the basepan may be configured to provide an open channel for disposal of condensate. Such arrangements, however, do not facilitate the attachment of a drain hose or the like to collect and direct the condensate to a desired location rather, they just allow dripping of the condensate through the channel from which it falls, under the influence of gravity, to the ground or whatever happens to lie under the unit.

In larger air conditioners having metal basepans, an optional drain opening is sometimes provided in the bottom of the basepan. A separate component is provided which may be assembled to the basepan upon punching out the opening, which will allow drainage of the condensate therethrough and which will provide a fitting on the lower side of the basepan for installation of a drain hose or the like. Such components are usually shipped separately and must be installed by the end user during installation or following installation in order to avoid damage to the drain fitting extending below the basepan. It being understood that, during installation, the lower part of the basepan quite often is slid horizontally across the support surface for the air conditioner, whether it be a window or a rectangular opening in a wall of the room to be cooled.

It is accordingly desirable to have a simple condensate drain arrangement for an air conditioner having a metal basepan, which will facilitate drainage of the excess condensate from the rear thereof and facilitate attachment of a disposal hose thereto for direction of the condensate to a desired collection location.

DISCLOSURE OF THE INVENTION

A condensate drain outlet for a room conditioner of the type which includes a sheet metal basepan having a horizontally extending bottom wall and a rear wall joined to and extending upwardly from the bottom wall in a perpendicular relationship. The rear wall has a substantially U-shaped opening formed therein. A one-piece molded plastic condensate drain insert for insertion into the U-shaped opening includes a mounting plate having a size configured to overly the U-shaped opening in the rear wall and having an opening extending therethrough. A tubular section, having an axial opening extending therethrough, extends from one side of the mounting plate. A U-shaped section extends a distance greater than the thickness of the rear wall from the other side of the mounting plate. The U-shaped section has an open back, and an inner surface which is in fluid communication with the opening in the plate and the opening in the tubular section. The U-shaped section includes an outer surface which is configured to be received in a close tolerance fit with the U-shaped opening in the rear wall. The U-shaped section also includes a peripheral U-shaped retaining flange extending outwardly from the outer surface. The flange has a retaining surface formed thereon, which is spaced from the other side of the mounting plate by a distance substantially equal to the thickness of the rear wall. Accordingly, installation of the drain insert is accomplished by inserting the U-shaped section into the U-shaped opening in the rear wall with the mounting plate in confronting relation and overlying the U-shaped opening. At the same time, the retaining surface of the retaining flange engages the other side of the rear wall.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
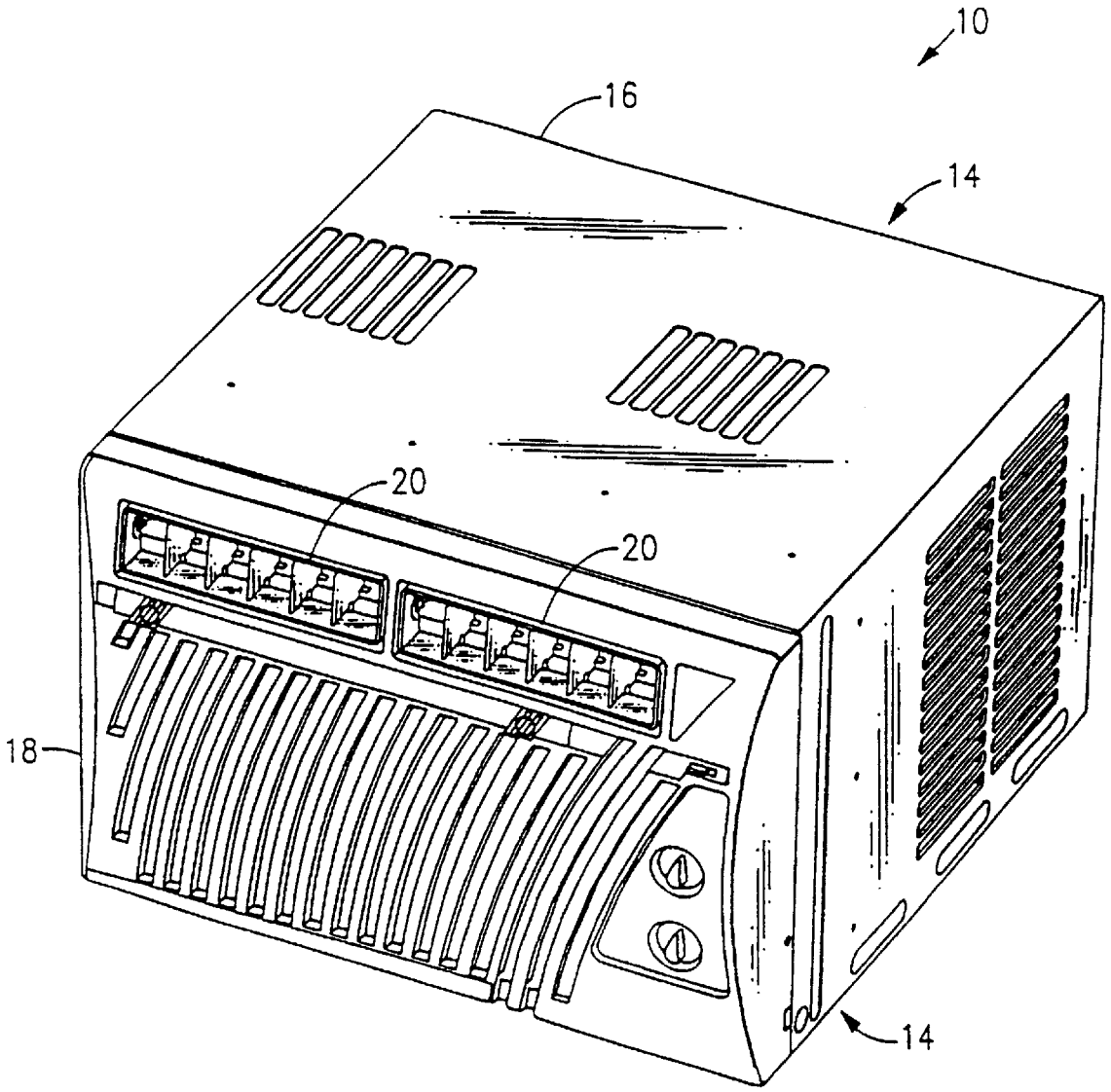
FIG. 1 is a perspective view of a room air conditioner which embodies the features of this invention.
Figure 2:
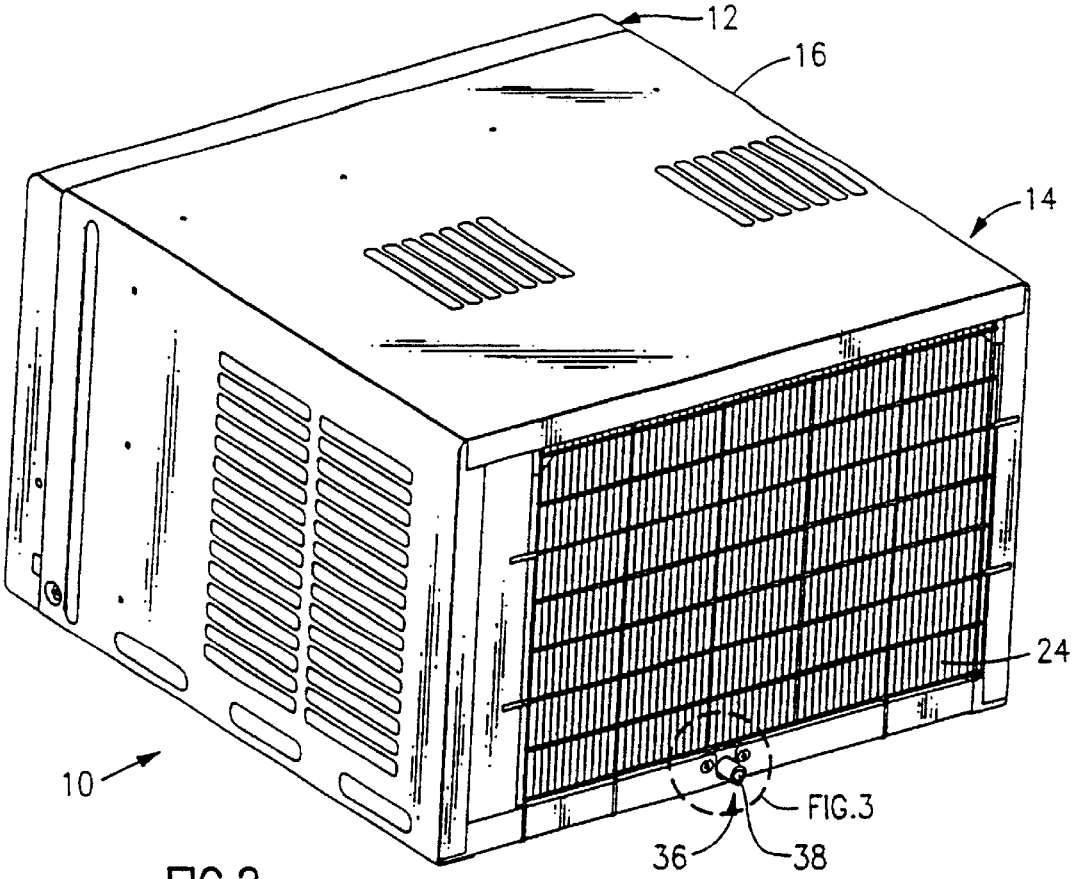
FIG. 2 is a rear perspective view of the air conditioner of FIG. 1.

FIGS. 1 and 2 illustrate an air conditioner unit 10, which includes, generally, an indoor section 12 and outdoor section 14. The room air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille 18, which includes a pair of conditioned air discharge assemblies 20. The components of both the indoor section 12 and the outdoor section 14 are conventional for a window room air conditioner and are supported in a rectangular metal basepan 22, which in turn is supported within the housing 16.

Figure 3:
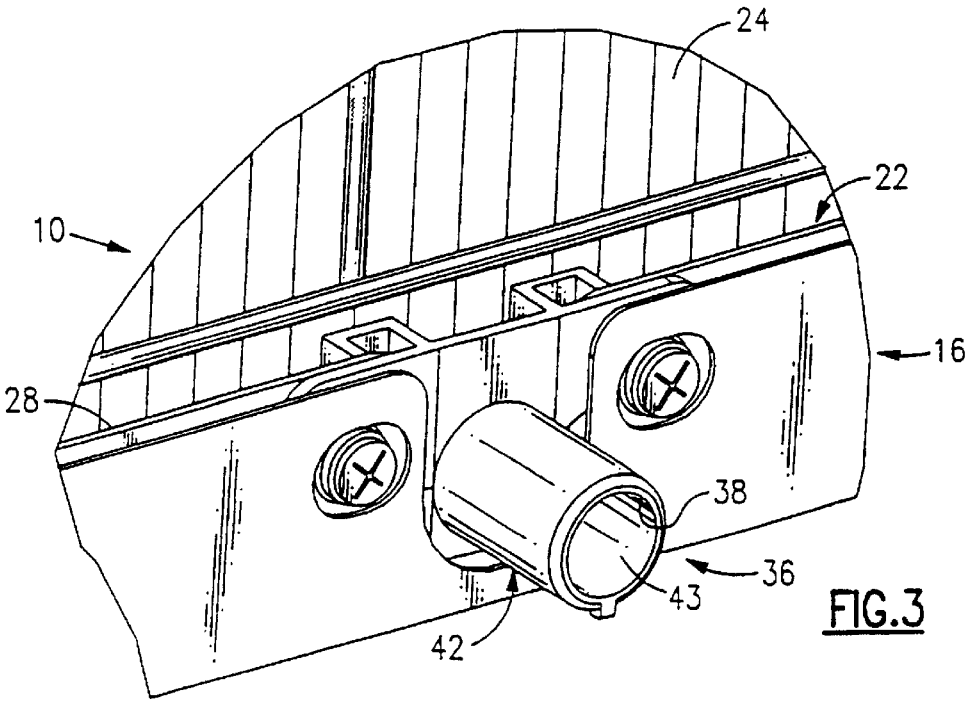
FIG. 3 is an enlarged view of the region identified as FIG. 3 in FIG. 2.
Figure 4:
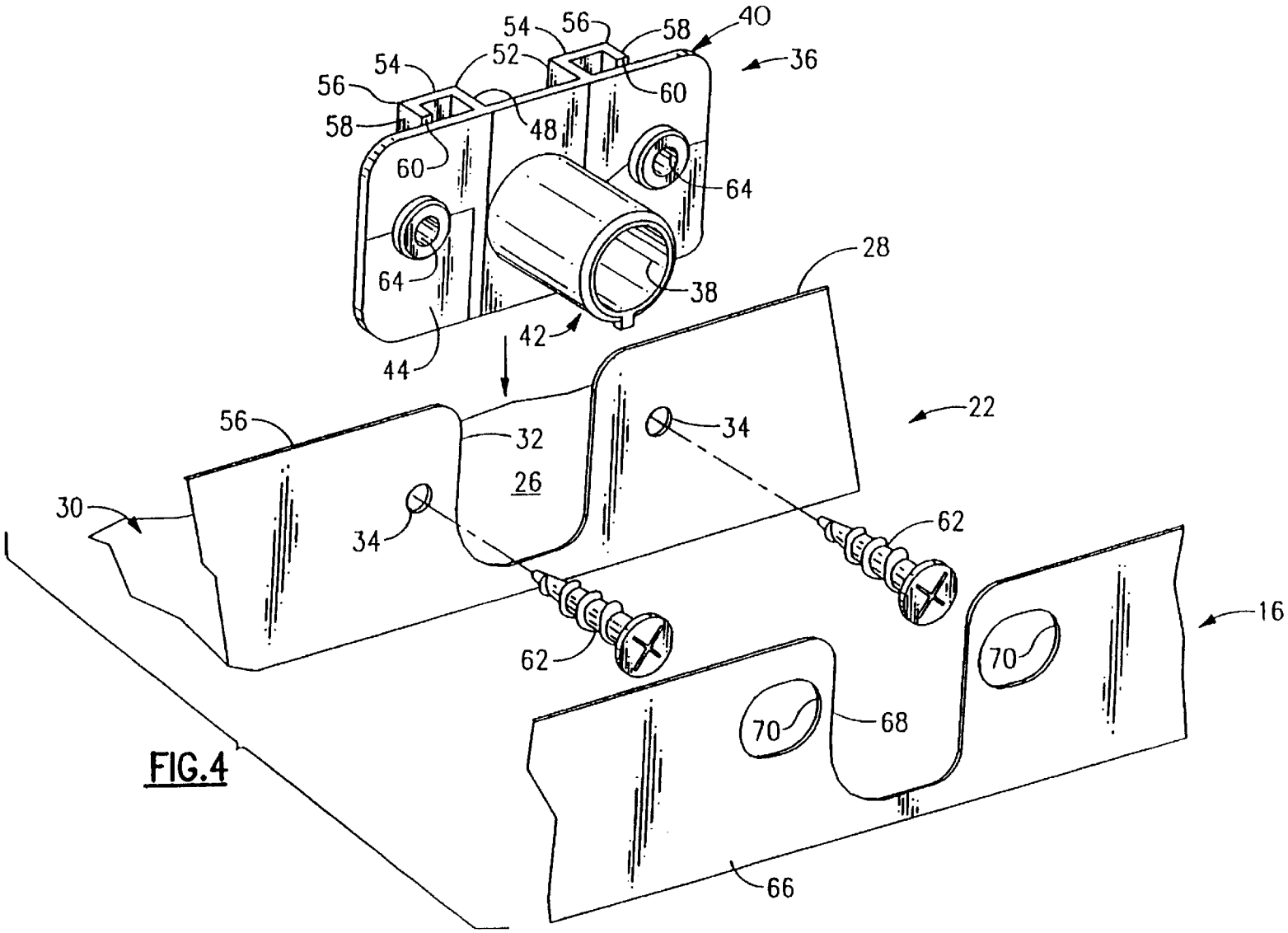
FIG. 4 is an exploded view of the insert, basepan and outer housing, as illustrated in FIG. 3.
Figure 5:
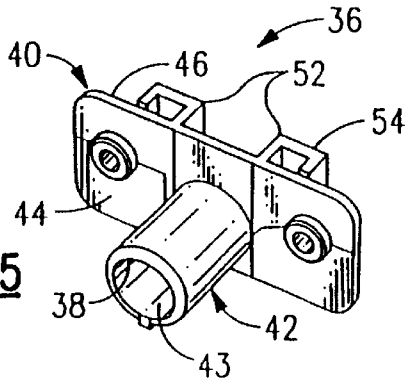
FIG. 5 is a perspective view of the condensate drain insert of the present invention.
Figure 10:
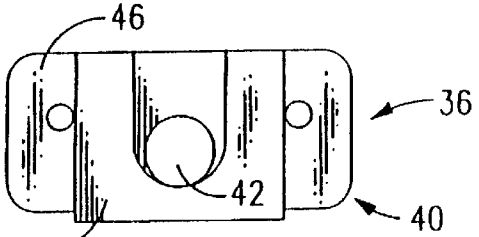
FIG. 10 is a rear view of the insert, as shown in FIG. 6.
Figure 9:
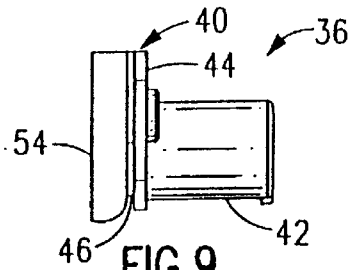
FIG. 9 is a right side view of the insert, as shown in FIG. 6.
Figure 8:
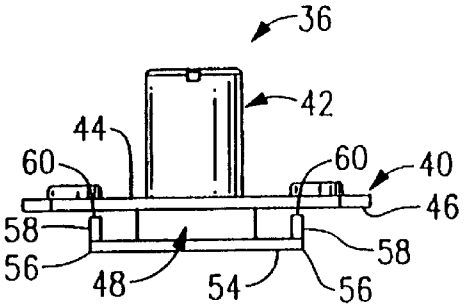
FIG. 8 is bottom view of the insert, as shown in FIG. 6.
Figure 6:
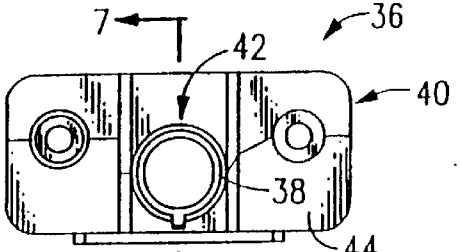
FIG. 6 is a front view of the insert of FIG. 5.
Figure 11:
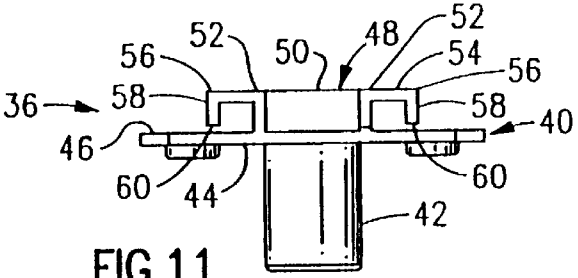
FIG. 11 is a top view of the insert, as shown in FIG. 6.
Figure 7:
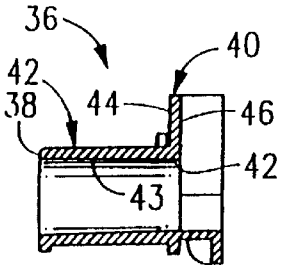
FIG. 7 is a view taken along the line 7—7 of FIG. 6.

Looking specifically at FIGS. 2, 3 and 4, the outdoor section 14 includes a condenser coil 24 vertically located adjacent the rear of the basepan 22. Other internal components of the air conditioner system are not relevant to an a understanding of the present invention and are not illustrated and will not be described further herein. It is well understood in the art, however, that during operation of such a unit and in the present unit, excess condensate removed from the air being conditioned will accumulate in the region of the basepan 26 adjacent the rear wall 28 thereof, as illustrated in FIG. 4.

With continued reference to FIGS. 2, 3 and 4, the basepan 22 is formed from a sheet metal material and includes a planar bottom wall 30 from which the rear wall 28 extends upwardly and perpendicularly therefrom. A U-shaped notch 32 is formed in the rear wall adjacent the condensate collection region 26. A pair of through openings 34 are provided in the rear wall 28 on opposite sides of the U-shaped notch 32.

As shown in detail in FIGS. 2–11, a one-piece molded plastic condensate drain insert 36, hereinafter "insert 36", is configured to be received in the U-shaped notch 32 in the rear wall 28 to provide fluid flow communication from the condensate collection region 26 to an outlet orifice 38 which may be in turn placed in fluid flow communication with an appropriate condensate collection hose or the like.

The insert 36 includes a planar mounting plate 40, which has a height substantially the same as the rear wall 28 and a width such that it will overly both the U-shaped notch 32 and the openinos 34 in the rear wall. The mounting plate 40 has a circular opening 41 therethrough, which is in fluid flow communication with an axial opening 43 extending through a tubular section 42, which extends from the outside surface 44 of the plate.

The outer end of the tubular section 42 defines the previously referenced drain orifice 38.

Extending from the inside surface 46 of the mounting plate 40 by a distance greater than the thickness of the rear wall is a substantially U-shaped section 48, which is configured to be received in a close tolerance fit with the U-shaped opening 32 in the rear wall. The U-shaped extension 48 has an open back 50, which completes the fluid communication of the insert 36 with the condensate collection region 26 within the basepan 22. Extending outwardly from a back edge 52 of the U-shaped extension 48 is a U-shaped retaining flange 54. Extending perpendicular to the left and right outer edges 56 of the U-shaped flange 54 and in a direction towards the inside surface 46 of the mounting plate 40 are a pair of wall sections 58, which each terminate in a retaining surface 60, which is spaced from the inside surface 46 by a distance such that the retaining surfaces 60 and the inside surface 46 will receive the thickness of the rear wall 28 in a close tolerance fit with the rear wall 28 disposed therebetween.

Accordingly the insert is assembled to the rear wall 28 of the basepan by inserting the U-shaped extension 48 vertically downwardly into the U-shaped opening 32, as illustrated in FIG. 4. Such insertion results in the previously described close tolerance fit between the U-shaped section 48 and the U-shaped opening 32 and the retaining surfaces 60 and the inside surface 46 of the mounting plate with the rear wall 28.

While the above described interference fit will provide a positive attachment of the insert to the rear wall in order to prevent separation of the components, a pair of appropriate threaded fasteners 62 are inserted through openings 64 provided on the mounting plate 40, which are in axial alignment with the openings 34 in the rear wall 28.

Looking now at FIGS. 2–4, the lower wall 66 of the back housing 16 is provided with a U-shaped opening 68, which is sized to receive the tubular section 42 of the insert in a clearance fit relationship. Also provided in the housing wall 66 are a pair of through openings 70 configured to receive and provide access to the heads 72 of the threaded fasteners 62. This arrangement facilitates ready removal and replacement of the insert 36 should it be damaged during the lifetime of the air conditioning unit.

What is claimed is:

1. A condensate drain outlet for a room air conditioner comprising a sheet metal basepan having a substantially horizontally extending bottom wall and a rear wall joined to said bottom wall and extending upwardly in a substantially perpendicular relationship therewith, said basepan having a region adjacent said rear wall for collecting excess condensate;

said rear wall having a substantially U-shaped opening formed therein adjacent said condensate collection region;

a one-piece molded plastic condensate drain insert comprising:

a mounting plate of such a size configured to overlie said U-shaped opening in said rear wall, said plate having an opening extending therethrough;

a tubular section having an axial opening extending therethrough extending from one side of said plate, said opening being in axial fluid flow communication with said opening in said plate;

a substantially U-shaped section extending, a distance greater than the thickness of said rear wall, from the other side of said plate, said U-shaped section having an open back, an inner surface in fluid communication with said opening in said plate, and, an outer surface configured to be received in a close tolerance fit with said U-shaped opening in said rear wall, said U-shaped section having a peripheral U-shaped retaining flange extending outwardly from said outer surface, said flange having a retaining surface formed thereon spaced from said other side of said plate by a distance substantially equal to the thickness of said rear wall;

whereby substantially U-shaped will be received in said substantially U-shaped opening of said rear wall with said mounting plate in confronting relation and overlying said U-shape opening, with said retaining surface of said retaining flange engaging the other side of said rear wall.

2. The apparatus of claim 1 wherein said retaining flange comprises a pair of L-shaped extensions having a first leg extending substantially parallel to said U-shaped section and a second leg extending perpendicular thereto and having a free end, which defines said retaining surface thereof.

3. The apparatus of claim 1 wherein said mounting plate comprises a pair of mounting openings therethrough on opposite sides of said drain opening, and wherein said rear wall has a pair of mounting openings in axial alignment with the openings of said plate and said axially aligned openings in said rear wall being adapted to receive sheet metal retaining screws therein.

4. The apparatus of claim 1 wherein said air conditioning unit further includes an outer housing said housing being configured to receive said basepan therein said housing having a rear wall configured to extend parallel to and in contact with said rear wall of said basepan said rear wall of said housing having a U-shaped opening formed therein to receive said tubular section therein and a pair of circular openings adjacent said U-shaped opening to provide access to said retaining openings in said mounting plate.

* * * * *